US006656235B2

(12) United States Patent
An

(10) Patent No.: US 6,656,235 B2
(45) Date of Patent: Dec. 2, 2003

(54) METHOD OF MAKING SILVER-CONTAINED CANDLE

(76) Inventor: Jung-O An, 105, Singseong B/D, #283, 6-ga, Dangsan-dong, Yeongdeungpo-gu, Seoul 150-046 (KR)

( * ) Notice: Subject to any disclaimer, the term of this patent is extended or adjusted under 35 U.S.C. 154(b) by 0 days.

(21) Appl. No.: 10/204,422

(22) PCT Filed: Mar. 10, 2001

(86) PCT No.: PCT/KR01/00375

§ 371 (c)(1),
(2), (4) Date: Aug. 29, 2002

(87) PCT Pub. No.: WO01/66680

PCT Pub. Date: Sep. 13, 2001

(65) Prior Publication Data

US 2003/0038404 A1 Feb. 27, 2003

(30) Foreign Application Priority Data

Mar. 10, 2000 (KR) ..... 2000-11943

(51) Int. Cl.[7] ..... C11C 5/00; C11C 5/02
(52) U.S. Cl. ..... 44/275; 431/288
(58) Field of Search ..... 44/275; 431/288, 431/289

(56) References Cited

U.S. PATENT DOCUMENTS

| | | | | |
|---|---|---|---|---|
| 3,958,917 A | | 5/1976 | Naz | 431/289 |
| 4,270,823 A | * | 6/1981 | Kuznetzoff | 445/24 |
| 4,449,987 A | | 5/1984 | Lindauer | 431/288 |
| 4,699,763 A | * | 10/1987 | Sinharoy et al. | 419/11 |
| 5,171,329 A | | 12/1992 | Lin | 44/275 |
| 5,261,952 A | * | 11/1993 | Craig | 523/164 |
| 5,383,954 A | * | 1/1995 | Craig | 106/31.08 |
| 6,033,464 A | * | 3/2000 | Craig | 106/31.29 |

* cited by examiner

*Primary Examiner*—Margaret Medley
(74) *Attorney, Agent, or Firm*—Greenblum & Berstein, P.L.C.

(57) ABSTRACT

A method for manufacturing silver containing candles includes preparing a candle composition containing main components of paraffin, hardening oil and stearic acid, and adding fine silver particles to the main components. A wick is prepared by soaking a multi-ply thread in a solution containing silver and drying the thread. The wick is fixed on a mold frame and the candle composition is poured into the mold frame. The silver particles are dispersed in the air by thermal convection during burning, so that the dispersed silver particles produce disinfecting and human-beneficial effects.

3 Claims, 1 Drawing Sheet

METHOD OF MAKING SILVER-CONTAINED CANDLE

TECHNICAL FIELD

The present invention relates to a manufacturing method of silver-contained candles including fine silver particles which in candles' burning are dispersed in the air and show a disinfectant effect and human-beneficial effects and the present invention also relates to the candle manufactured by above mentioned method.

BACKGROUND ART

Candles are generally used for providing light. Also candles for fragrance have been prepared for creating a festive atmosphere in house.

Furthermore, as known in the art, candles are manufactured by adding paraffin (m.p. is 51~57° C.) with 5~30% of stearic acid for enhancing their opacity and stiffness and by inserting a wick into theam, wherein said wick has been treated with the mixture of ammonium phosphate, ammonium sulfate, and boric acid.

Manufacturing process of candles includes pouring melted candle into a candle-manufacturing device and preparing candles by shrinkage along with cooling. In the art, this shrinkage in cooling candles has made candle processes require that the melted candle, mixed with paraffin and stearic acid, should be poured into candle-manufacturing device and then be cooled.

However, the major role of these candles in the art is almost only to light up and remove darkness. Also, the fragrance-candles, although they can release fragrant particles over the whole in candles' burning, have no beneficial effect on human bodies.

Therefore, in considering said problems of candles in the art, the present invention is devised to provide a manufacturing method of candle containing silver including fine silver particles which, in candles' burning, are dispersed in the air and show a disinfectant effect and human-beneficial effects.

A conventional memo holder for computer consists of a support fixed to one side of a computer monitor, a supporting shaft and a memo clamp.

However, since such conventional memo holder for a computer is manufactured to have only simple function for holding the memo paper, various types of memo holder cannot be realized.

Also, since the conventional memo holder for a computer is moved along one axis, the transition of the memo holder is defined.

DISCLOSURE OF THE INVENTION

The present invention was achieved by manufacturing the inventive candle by fixing the wick in the frame and then pouring the melting solution into the frame and enhancing a disinfecting effect of the candles owing to the silver particles dispersing in the whole room in candles' burning, wherein said wick are prepared by soaking multi-ply thread in the solution containing 100 ppm of silver with purity of 99.99% and drying the soaked thread; and wherein said melting solution contains the fine silver particles as well as the main components such as paraffin, hardening oil, and stearic acid.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
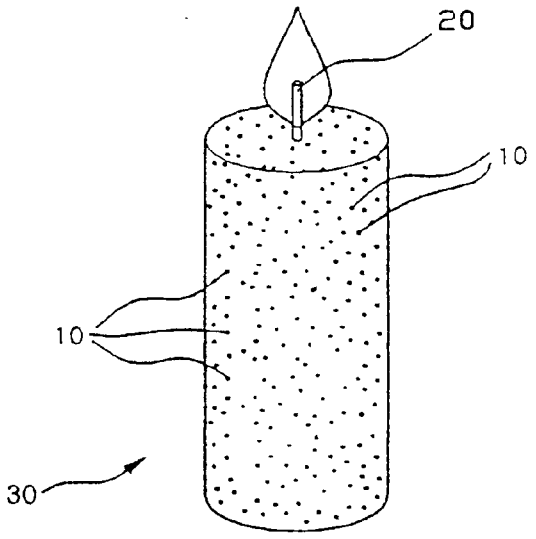
FIG. 1 illustrates a preferred embodiment of a candle containing in the present invention.

Reference now should be made to the drawings, in which the same reference numerals are used throughout the different drawings to designate the same or similar components.

Below, the example provides a more detailed description of a preferred embodiment in the drawing.

Figure 2:
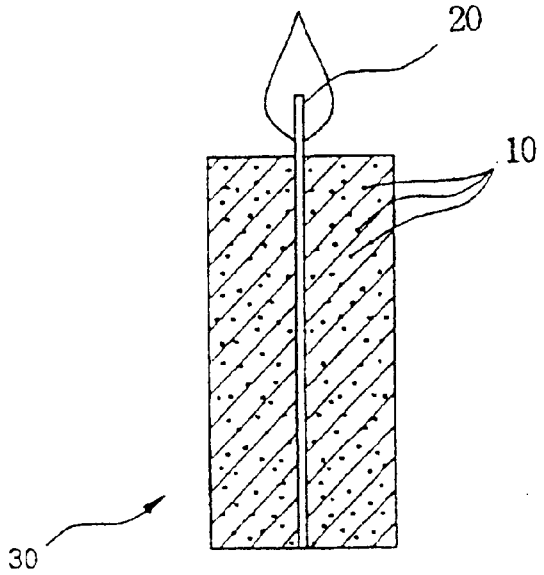
FIG. 2 illustrates a cross-sectional view of the inventive candle.

The candle of the present invention, illustrated in FIG. 1 and FIG. 2 is prepared by fixing the wick 20 on a mold frame and pouring the melting solution into the mold frame, wherein said melting solution contains fine silver particles 10 as well as main components such as paraffin, hardening oil, and stearic acid, and said wick 20 is prepared by soaking multi-ply thread in the solution containing 100 ppm of silver with purity of 99.99% and drying the soaked thread.

The melting solution is prepared by mixing the fine silver particles with paraffin, hardening oil, and stearic acid as main components.

Following the preparation, the wick 20 is prepared by soaking multi-ply thread in the solution containing 100 ppm of silver with purity of 99.99% and drying the soaked thread. The silver (99.99% pure) content can be 3~150 ppm.

The wick 20 soaked in said melting solution is fixed in the molding frame, and then the frame is filled with the melting solution containing silver. Finally, the candle 30 containing silver is prepared along with hardening by cooling the melting solution poured into the frame.

As the above mentioned, the steps of manufacturing said candle 30 are described and changing the order of the manufacturing steps will causes no effect on the purpose of the present invention.

Another example of the present invention is a candle containing paraffin, hardening oil, stearic acid and fragrant additive as major components, wherein fine silver particles are added to a melting solution of said candle releasing fragrance for enhancing fragrance and disinfecting effect, resulting in advantages in the sense of smell and health.

Another example of the present invention is a candle prepared by fixing the wick 20 on a mold frame and pouring the melting solution into the mold frame, wherein said melting solution contains fine silver particles 10 as well as main components such as paraffin, hardening oil, and stearic acid; and said wick 20 is prepared by soaking multi-ply thread in the solution containing 30~150 ppm of silver with purity of 99.99% and drying the soaked thread.

All of the aforementioned candles can be prepared in various shapes and forms.

The above examples are offered to illustrate this invention and are not meant to be construed in any way as limiting the scope of this invention. An expert in the art can sufficiently understand desirable examples of the present invention and embody the candle-manufacturing device and manufacturing method similar with this invention. Also, the range of the present invention must be decided by the following claims based on technical concept of the present invention.

Industrial Applicability

Aforementioned examples ensure that the present invention provides the candle containing silver particles, which would be dispersed in the air by thermal convection, so produce remarkably disinfecting and human-beneficial effects. Thus the present invention is useful for the candle industry.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method of making a silver containing-candle, comprising:

preparing a candle composition containing paraffin, hardening oil and stearic acid as the main components; and adding fine silver particles to the main components.

2. The method of making a silver containing-candle according to claim 1, further comprising:

preparing a wick by soaking multi-ply thread in a solution containing 30–150 ppm of silver with purity of 99.99% and drying the soaked thread; and fixing said wick on a mold frame and pouring said candle composition into the mold frame.

3. The method of making a silver containing-candle according to claim 1, further comprising adding a fragrance additive.

* * * * *